US005526599A

United States Patent [19]

Roussel

[11] Patent Number: 5,526,599

[45] Date of Patent: Jun. 18, 1996

[54] MANUALLY OPERABLE DISPLAY DEVICE

[76] Inventor: Daniel Roussel, 1 Lacroix, Sayabec Quebec, Canada, G0J 3K0

[21] Appl. No.: 183,801

[22] Filed: Jan. 21, 1994

[51] Int. Cl.[6] ..... G09F 3/04

[52] U.S. Cl. ..... 40/450; 40/492

[58] Field of Search ..... 40/450, 451, 492, 40/497, 533, 447

[56] References Cited

U.S. PATENT DOCUMENTS

| | | | |
|---|---|---|---|
| 3,740,878 | 6/1973 | Oelschlaeger | 40/447 |
| 4,063,377 | 12/1977 | Hukill | 40/492 X |
| 4,777,747 | 10/1988 | Murray, Jr. | 40/447 |
| 5,315,775 | 5/1994 | Parker et al. | 40/447 X |
| 5,388,356 | 2/1995 | Kalivas | 40/450 |

*Primary Examiner*—Peter M. Cuomo
*Assistant Examiner*—James O. Hansen

[57] ABSTRACT

A display device for allowing quick and easy manual modification of the displayed information. A set of display plates each having two sides and a central bore which are parallel to one another are kept releasably biased against a backboard by a corresponding set of resilient strips extending through the plates. Each one of the bores of the plates has a contrasting surface colored with a color contrasting with respect to the backboard. The plates are selectively pulled away from the backboard and pivoted about said bore in either direction to expose their contrasting surfaces in order to form displayed numerals, letters or other symbols. The pivoting action is very fast and the plates cover the same area of the backboard in both their pivoted positions.

9 Claims, 5 Drawing Sheets

MANUALLY OPERABLE DISPLAY DEVICE

FIELD OF THE INVENTION

The present invention relates to the field of digital display devices and is particularly concerned with a digital display device having manually pivotable segments which are resiliently connected to a background board.

PRIOR ART

Display devices often require that the displayed information be changed. For example, bank windows which display changing interest rates conventionally use a plastic roll on which numbers are printed. The roll is rotated to expose, in a frame, the desired numbers. In another type of display, a frame receives a flat card having printed thereon an appropriate information. The flat card system is often used in situations where prices or rates vary periodically, for example, the price displays used at a gasoline stations and retail stores. These types of device necessitate that a separate card or a separate space on the roll be used for each given information. For example, a separate card must be used to display the numerals 8 and 9.

To circumvent this disadvantage, various display devices use a so-called "digital" type of display. Typically with the digital type of display, seven segments which can be selectively rendered visible are used to display anyone of the possible information. When numerical information is to be displayed, three of the seven segments are parallel, horizontally aligned and evenly spaced apart. The remaining four segments are aligned vertically, in two opposite pairs, to form with the three horizontal segments the numeral "8" in block digital appearance. The segments are selectively rendered visible and invisible to form any of the 10 arabic numeral characters. Various methods can be used to selectively render the segments either visible or invisible. One of the commonly used methods involves the use of electronic lighting means. However, these electronic devices are generally relatively costly.

Another frequently used method involves the use of colored segments which are manually selectively positioned over a corresponding set of segments printed on a supporting board surface. Examples of such structures are disclosed in U.S. Pat. No. 4,729,184 issued to Cihanck on Mar. 8, 1988 and U.S. Pat. No. 4,539,768 issued to Halliday on Sep. 10, 1985. In the Cihanck patent, the display device has a set of windows exposing a background color. Each one of the windows can be selectively covered by a hinged flap. The desired numerals are formed by opening and closing the appropriate flaps to expose the appropriate corresponding windows thereby displaying the desired numerals.

In the Halliday patent, the display apparatus comprises a board having seven element digital type displays marked thereon. A set of flaps pivotable from a first position in which the associated element is exposed to a second position in which it covers its associated element can be selectively pivoted in order to form any required digit.

The type of structure disclosed both in the Cihanck patent and the Halliday patent suffers from at least three disadvantages. Firstly, the flaps which are used to cover the seven-element digital type displays segments or the digital type window segments are unesthetic when seen up-close in the position wherein they are not covering the segments. Secondly, the flaps may become damaged during repeated pivoting operations. Once damaged, the flaps may become less efficient.

Thirdly, the structures disclosed in both the Cihanck and Halliday patents suffer from the drawback that they are only particularly suited to display seven segments digital type characters. Indeed, the flaps of the Cihanck and Halliday patents require a space adjacent the corresponding segments which they are adapted to cover. This space is occupied by the flap when it is not in a position covering its corresponding segment. These necessary space limit the type of characters which can be displayed by the device.

Another type of structure is disclosed in U.S. Pat. No. 4,777,747 issued to Murray Jr on Oct. 18, 1988. Murray's display device employs one or more basic numerical arabic figure eight digits of a segmented construction. Each basic numerical eight is made up of segments having contrasting color with respect to a viewing background of the display. Numerical digits are selectively formed on each eight by applying or removing covering strip segments in such a manner as to leave exposed color segments that represent the desired numerical digit. The covering strip segments are removably slid into a corresponding guide rim. The covering strips are thus subject to being lost or damaged. If the covering strips become damaged, they may not fit into the guide rim.

Another display structure is disclosed in Canadian patent 1,284,428 issued to Jonh M. Carnell in May 28, 1991. Carnell uses magnetic strips to cover preselected portions of a ferrormagnetic backboard in order to form display characters. The device has two drawbacks magnetic material is relatively costly and the strips are easily lost or damaged.

OBJECTS OF THE INVENTION

Accordingly, an object of the present invention is to provide a manually operable display device which may be readily and easily changed, by hand, in order to display any alphanumeric character or any other type of character which is relatively rugged and durable, so that the characters may be changed numerous times without damage to structural integrity and which conforms to conventional forms of manufacturing in order to produce a display device which is economically feasible.

SUMMARY OF THE INVENTION

According to the present invention, there is provided a manually operable display device comprising a substantially planar backboard having a frontal viewing face and a back face, said frontal viewing face being colored with a background color, a set of substantially planar display plates, each one of said display plates having a contrasting face and a non-contrasting face, said contrasting face being colored with a color substantially contrasting with respect to said background color and each one of said non-contrasting face being colored with a color substantially non-contrasting with respect to said background color, each display plate defining two sides and a central pivotal axis which are all parallel, said central pivotal axis and both said faces being preferably also all parallel, a set of biasing means fixed to said plates and to said backboard for biasing any selected display plate towards said viewing frontal face of said backboard and retaining said display plate in a rest position flat against and covering a predetermined area of said backboard, so that either said contrasting face or said non-contrasting face of said display plate is in abutting relationship with said backboard, said biasing means allowing any selected plate to be temporarily pulled away from said backboard and pivoted one half turn about its pivotal axis to selectively expose either said contrasting face or said non-contrasting face and then to be returned to its rest position covering the same said predetermined area.

Conveniently, each one of said plates has a through bore coaxial with its pivotal axis and wherein said biasing means is a strip of substantially resilient material, said strip being fixed to said backboard and extending trough said bore for resiliently linking said plate to said backboard while allowing rotation of said plate about said bore.

In one embodiment of the present invention, each one of said plates is fixed to said backboard with a corresponding strip, each one of said bore has an entry and an exit end, each one of said strips is fixed to said backboard on opposite sides of said plate respectively adjacent said entry and exit ends.

Preferably, said plates have a longitudinal strip-like shape and are disposed in digital format subsets, each one of said subsets comprising seven of said display plates, three of said plates being parallel horizontally aligned and evenly spaced apart, the remaining four plates being aligned vertically in two opposite pairs in order to form with said three horizontal plates the numeral "8" in block digital appearance.

Conveniently, said backboard has a back face, each plate has a pair of opposed longitudinal ends, said bore extends longitudinally through said plates between said longitudinal ends, said backboard has a set of apertures extending perpendicularly therethrough, said apertures being located adjacent said longitudinal ends of said plates, said strip extends through said bore and through each corresponding pair of said apertures positioned adjacent said longitudinal ends, said strip protrudes through each of said apertures and then extends across said back face of said backboard between said apertures in order to form a loop.

Preferably, each side of each plate forms an edge having a subtantially bevelled cross-section. In a second embodiment of the invention, said plates are positioned in juxtaposed relationship forming an array of said plates, said array defining a set of plate columns and a set of plate rows, in each one of said rows, said plates have their throughbores in colinear relationship defining a row throughbores extending from a first plate at a first end of said row to a last plate at a second end of said row, each one of said strips extends through one of said row throughbores and is fixed to said backboard adjacent said first plate and said last plate.

In yet a third embodiment of the invention, said plates are positioned in juxtaposed relationship forming an array of said plates, said array defining a set of plate columns and a set of plate rows, in each one of said columns, said plates have their throughbores aligned in colinear relationship defining a column throughbores extending from a first plate at a first end of said column to a last plate at a second end of said column, each one of said strips extends through one of said column throughbores and is fixed to said backboard adjacent said first plate and said last plate.

BRIEF DESCRIPTION OF THE DRAWINGS

Embodiments of the invention will now be described, by way of example, with reference to the following drawings in which.

DETAILED DESCRIPTION OF THE PREFERRED EMBODIMENTS

Figure 1:
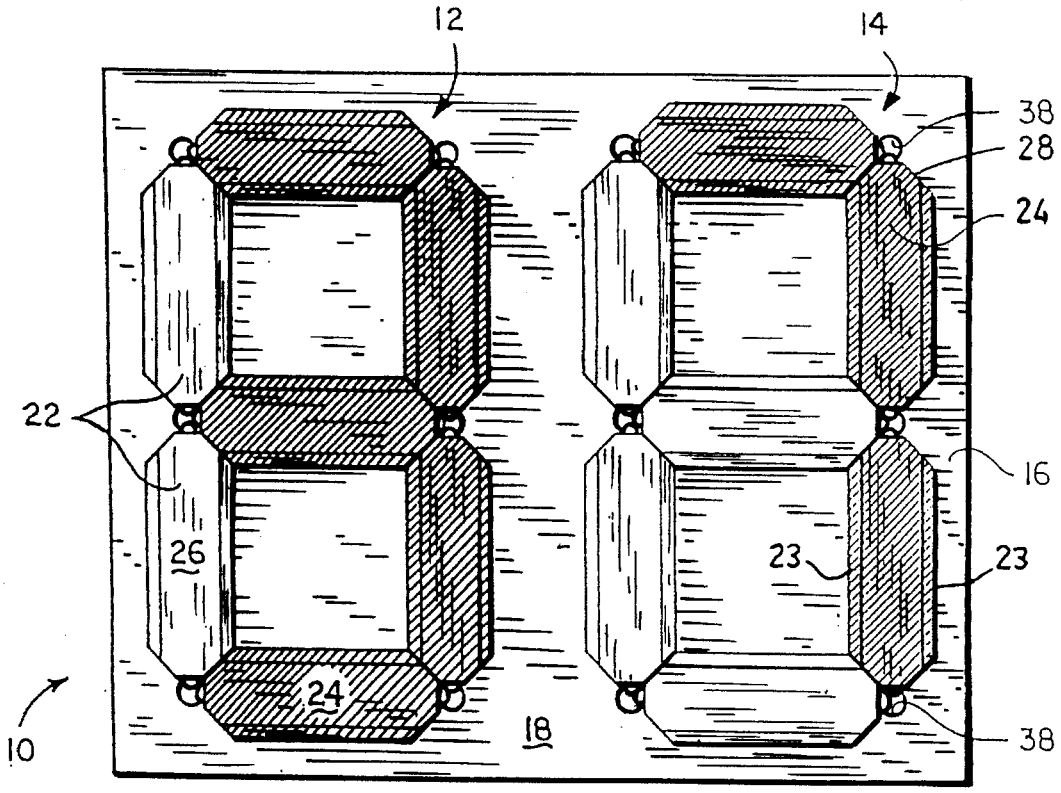
FIG. 1: in an elevational view, illustrates a display device in accordance with a first embodiment of the present invention, the display device displaying the numeral "37"

Referring to FIG. 1, there is shown a display device 10 in accordance with an embodiment of the present invention. The display device 10 is shown having two seven-segment digital-type displays 12 and 14. The display 12 is shown displaying the digit 3 while the display 14 is shown displaying the digit "7".

The display device 10 has a substantially planar backboard 16. The backboard 16 has a frontal viewing face 18 and a rear face 20. The viewing face 18 is colored with a color herein referred to as the background color. Each one of the displays 12 and 14 has a set of display segments in the form of substantially planar display plates 22. Each display plate 22 has a contrasting face 24 and a non-contrasting face 26. Each plate 22 has opposite wedge-shaped ends 28 which are in spaced-apart, aligned relationship with respect to the ends 28 of adjacent plates 22.

Figure 2:
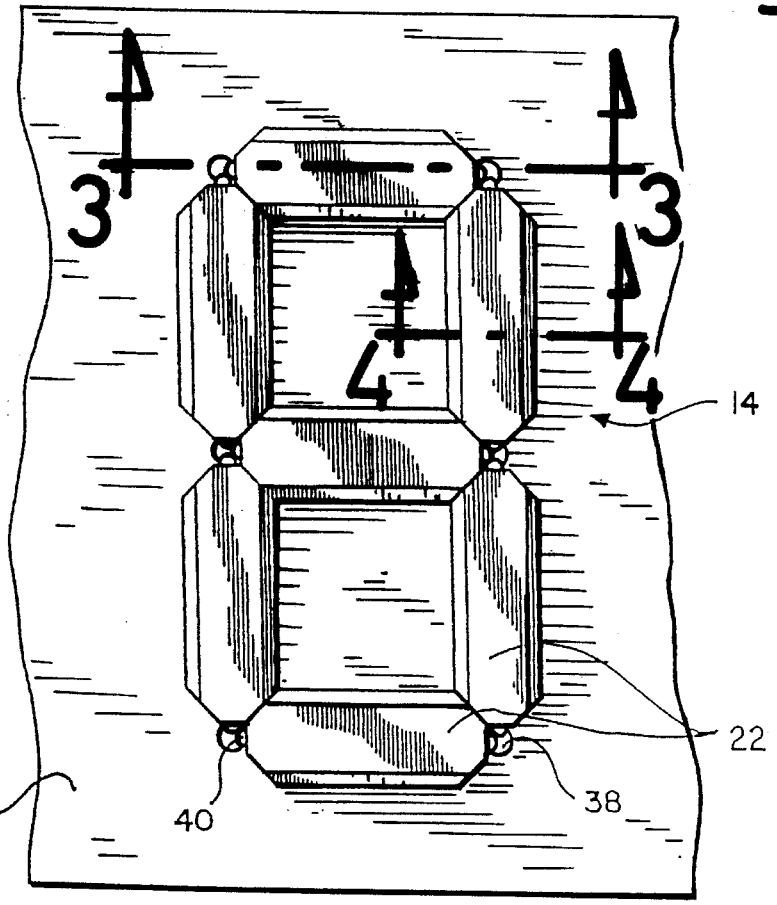
FIG. 2: in a partial elevational view of FIG. 1, illustrates the display device displaying no numeral
Figure 3:
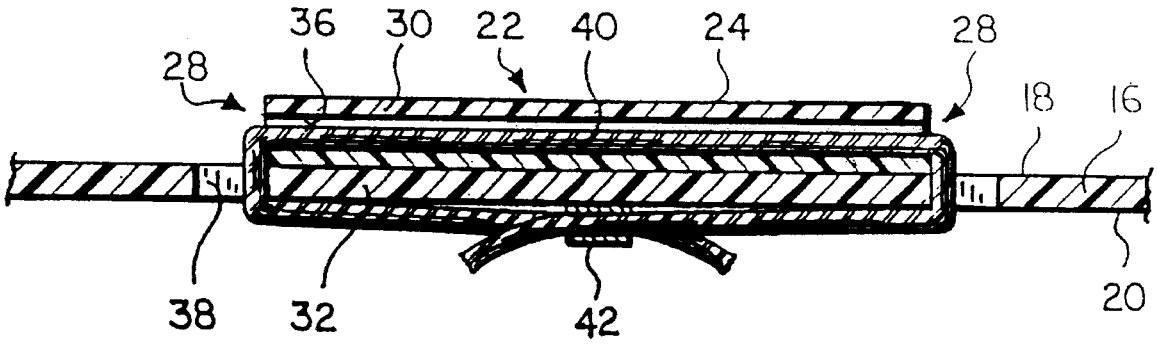
FIG. 3: in a longitudinal cross-sectional view, taken along lines 3—3 of FIG. 2, FIG. 4: in a transversal cross-sectional view, taken along lines 4—4 of FIG. 2, FIGS. 5 to 5*d* are sequential views illustrating the steps associated with pivoting a display plate from a position wherein its non-contrasting face is exposed to a position wherein its contrasting face is exposed.
Figure 4:
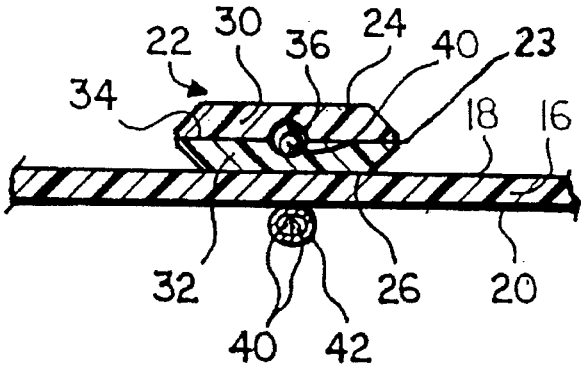

As illustrated more specifically in FIGS. 2 and 4, each plate has parallel sides 23 which preferably form bevelled side edges when the plate is seen in cross-section. Typically, the plates 22 are formed of two superposed half plates 30 and 32 glued together about their contacting surface 34 one half plate being coloured with the colour of face 24 and the other half plate being coloured with the colour of face 26.

Each plate 22 has a longitudinal central throughbore 36 which is parallel to sides 23 and to faces 24 and 26 which defines the pivotal axis of plate 22.

The backboard 16 has a set of apertures 38 extending perpendicularly therethrough. The apertures 38 are located adjacent the ends 28 of the plates 22.

The contrasting face 24 of the plates 22 is colored with a color substantially contrasting with respect to the background color. The non-contrasting face 26 of the plates 22 is colored with a substantially non-contrasting color with respect to the background color.

According to the conventional digital format, the displays 12 and 14 comprise seven display plates 22. Three of the plates 22 are parallel, horizontally aligned and evenly spaced apart, the remaining four plates 22 are aligned vertically in two opposite pairs in order to form with the three horizontal plates 22 the numeral "8" in block digital appearance.

The plates 22 are typically longitudinal strip-like shaped with wedge-shaped opposite ends 28. For each plate 22, a biasing means, such as a strip 40 of relatively resilient material is adapted to extend through bore 36 and through each corresponding pair of apertures 38 positioned adjacent the corresponding ends 28. The strip 40 protrudes through each one of the apertures 38 and then extends across the rear face 20 of the backboard 16 between the apertures 38. In one embodiment, the strip 40 is made of a rubber strip. Both ends of the strip 40 are joined together by a sleeve 42 thus forming a loop. The loop formed by the strip 40 which passes through the bore 36, through a set of opposed apertures 38 and along the rear face 20 of the backboard 16 is adapted to bias the plate 22 against the frontal viewing face 18 of the backboard 16.

In use, the plates 22 are adapted to be pivoted about their central pivot axis between a first position wherein the non-contrasting face 26 is exposed and a second position wherein the contrasting face 24 is exposed, the plates covering in both positions the same are a of face 18 of backboard 16. The displays 12 and 14 display digits such as the digits "3" and "7" of FIG. 1 by having selected plates 22 with their contrasting face 24 exposed according to conventional arabic numeral configuration.

For example, to form the digit "7" is formed by selectively pivoting the plates 22 so that the top horizontal plate and the two plates forming the right vertical column have their contrasting face exposed and their non-contrasting face abuting against the frontal viewing face 18 of the backboard 16.

Figure 5:
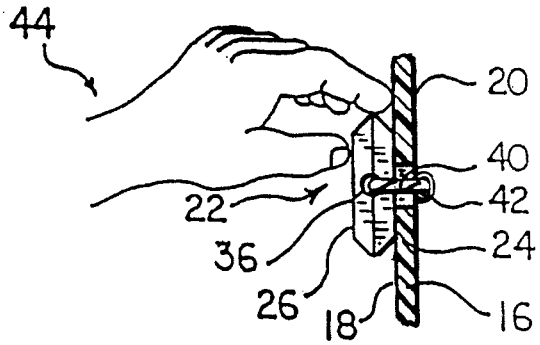
Figure 5A:
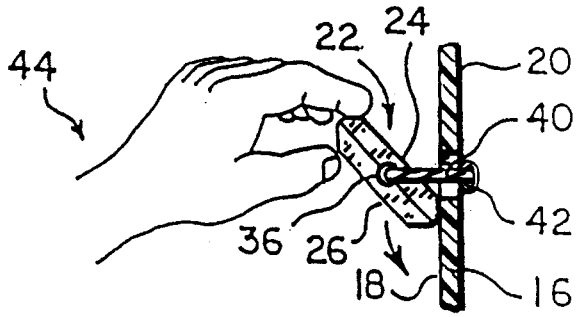
Figure 5B:
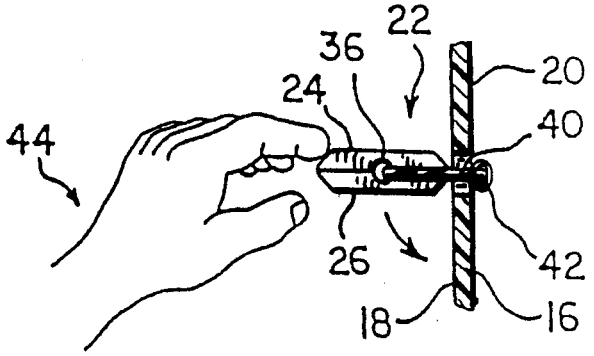
Figure 5C:
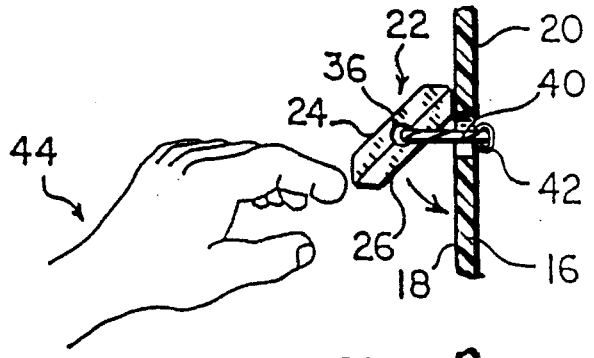
Figure 5D:
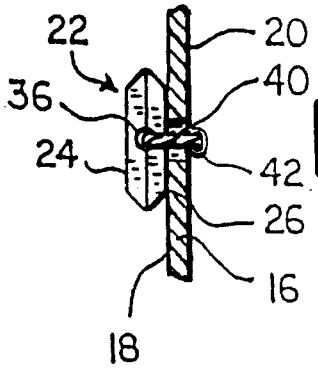
Figure 6:
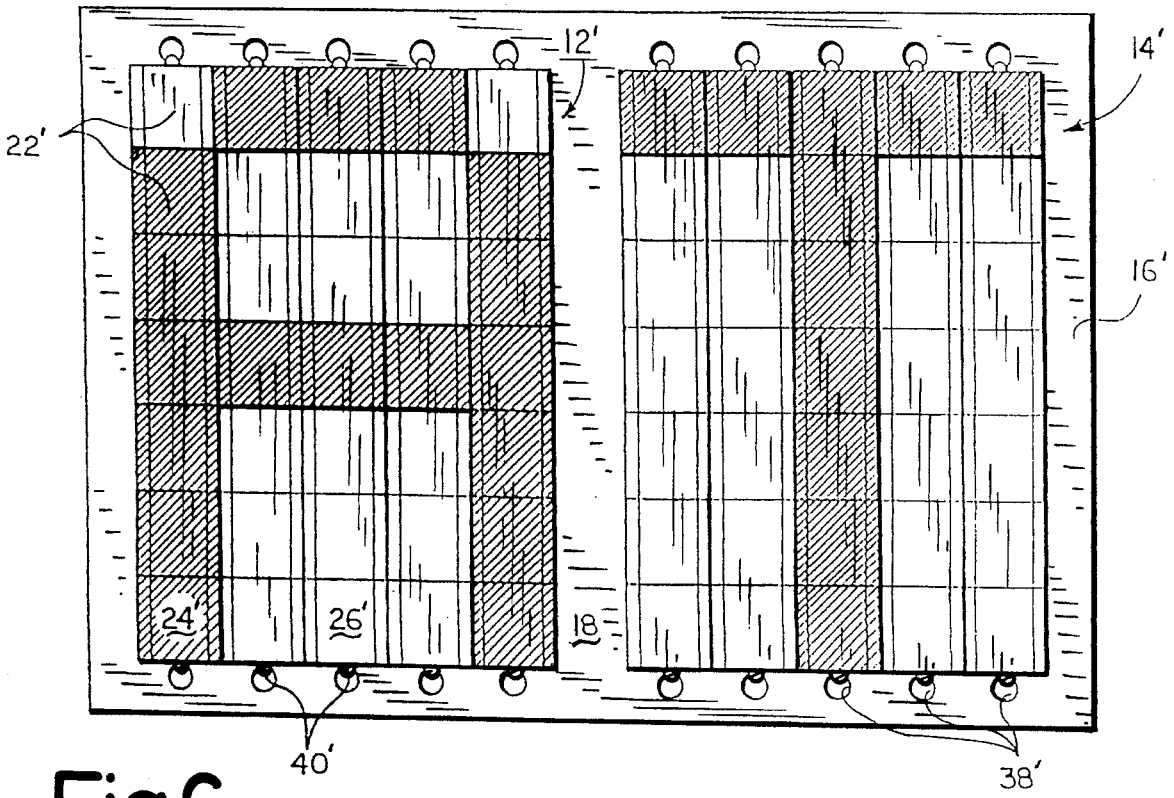
FIG. 6: in an elevational view, illustrates a display device in accordance with a second embodiment of the present invention, the display device displaying the letters "AT"
Figure 7:
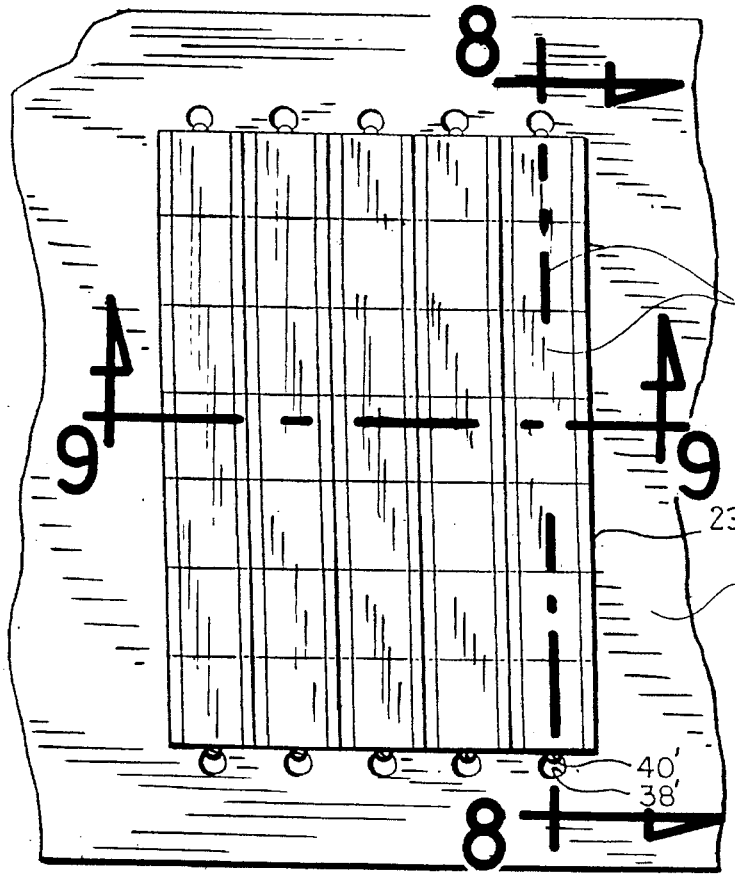
FIG. 7: in a partial elevational view of FIG. 6, illustrates a display device in accordance with a second embodiment of the present invention, the display device displaying no letter.
Figure 8:
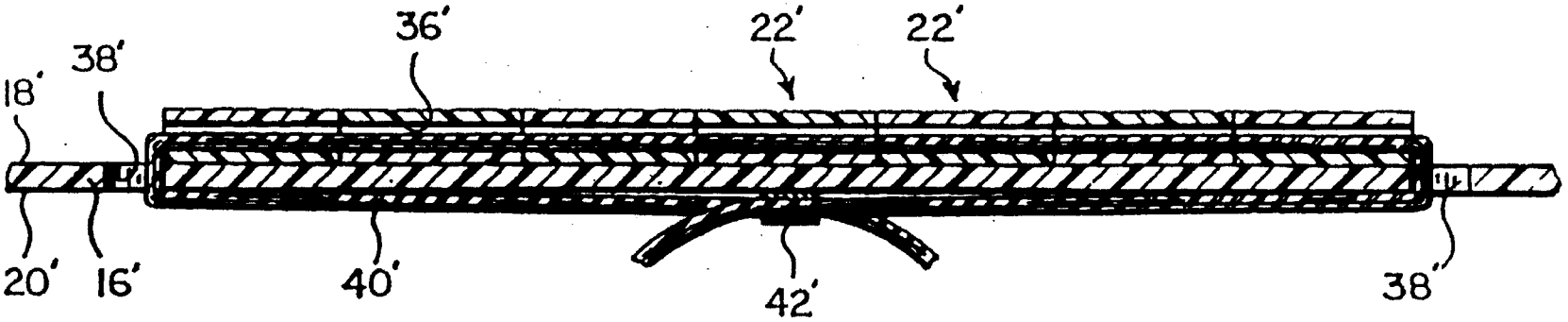
FIG. 8: is a longitudinal cross-sectional view taken along line 8—8 of FIG. 7, and FIG. 9: is a transversal cross-sectional view, taken along line 9—9 of FIG. 7, illustrate the relationship between the backboard and a display plate part of a display device in accordance with a second embodiment of the present invention.

FIGS. 5 to 5*d* illustrate the steps associated with pivoting a plate 22 from a position wherein its non-contrasting face 26 is exposed to a position wherein its contracting face 24 is exposed. As can be seen, the hand 44 of the user first grasps one of the longitudinal edges 23 of the plate 22, pulling it away from the board 16. The pulling action resiliently stretches the strip 40. The plate 22 is pivoted about its longitudinal bore 36 by the user. The plate 22 is biased by the strip 40 back into a rest position in which it abuts flat on board 16 and covers the same board area as prior to pivoting. The strip 40 thus acts as a biasing means while allowing rotation of the plate 22 about its central pivotal axis. The bevelled longitudinal edges 23 of the plate 22 facilitate prehension of the plate 22 by the user. The bevelled edges also act as a pivoting surface.

FIGS. 6 through 9 illustrate a second embodiment 10' of the present invention. This second embodiment, is similar to the first embodiment 10 illustrated in FIGS. 1 through 5*d* except for the fact that the plates 22' of the second embodiment 10' are substantially parallelepiped-shaped and juxtaposed, thus forming an array of substantially juxtaposed plates 22'. Similarly to the first embodiment, the The display device 10' is shown having two thirty five-segment digital-type displays 12' and 14'. The display 12' is shown displaying the letter "A" while the display 14 is shown displaying the letter "T".

The display device 10' has a substantially planar backboard 16'. The backboard 16' has a frontal viewing face 18' and a rear face 20'. The viewing face 18' is colored with a color herein referred to as the background color. Each one of the displays 12' and 14' has a set of display segments in the form of substantially planar display plates 22'. Each display plate 22' has a contrasting face 24' and a non-contrasting face 26'. The plates 22' are in juxtaposed relationship with respect to one another.

Figure 9:
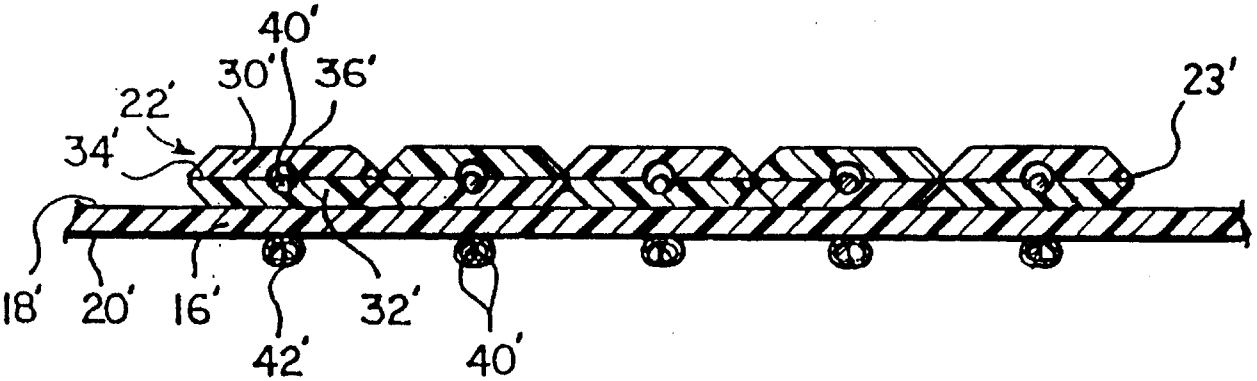

As illustrated more specifically in FIG. 9, the parallel side edges 23' of the plates 22' are beveled. Typically, the plates 22' are formed of two superposed half plates 30' and 32' glued together about their contacting surface 34'.

Each plate 22' has a throughbore 36' extending therethrough parallel to the surfaces 24' and 26' and centrally of and parallel to side edges 23'.

The backboard 16' has a set of apertures 38' extending perpendicularly therethrough, The apertures 38' are located adjacent the ends of plates 22 located at distal ends of a column or row formed by juxtaposed plates 22.

The contrasting face 24' of the plates 22' is colored with a color substantially contrasting with respect to the background color. The non-contrasting face 26' of the plates 22' is colored with a substantially non-contrasting color with respect to the background color.

The plates 22' are typically parallelepiped-shaped. For each column or row of juxtaposed plates 22', a biasing means, such as a strip 40' of relatively resilient material is adapted to extend through the corresponding bores 36' and through each corresponding pair of apertures 38'. The strip 40' protrudes through each one of the apertures 38' and then extends across the rear face 20' of the backboard 16' between the apertures 38'. In one embodiment, the strip 40' is made of a rubber strip. Both ends of the strip 40' are joined together by a sleeve 42' thus forming a loop. The loop formed by the strip 40' which passes through the bore 36', through a set of opposed apertures 38' and along the rear face 20' of the backboard 16' is adapted to bias the plate 22' against the frontal viewing face 18' of the backboard 16'.

In use, the plates 22' are adapted to be pivoted between a first position wherein the non-contrasting face 26' is exposed and a second position wherein the contrasting face 24' is exposed. The contrasting faces 24' are selectively exposed to correspondingly form letters or other symbols. The pivoting sequence is similar to the one illustrated in FIGS. 5 and 5*d* except for the initial prehension of the plate 22' by the user. With the second embodiment 10', since the plates 22' are juxtaposed, to facilitate prehension, the user may apply finger pressure to one of the exposed bevelled edges. The applied pressure will slightly pivot the plate 22, until the corresponding bevelled surface on the opposed face abbutingly contacts the board 16' thus slightly lifting the edge opposite the one on which the pressure is applied. The user may then grasp the slightly lifted edge and continue the pivoting sequence.

I claim:

1. A manually operable display device comprising:

a substantially planar backboard having a frontal viewing face and a back face, said frontal viewing face being colored with a background color, a set of substantially planar display plates, each one of said display plates having two parallel sides and a central pivotal axis intermediate and equidistant from said sides, each one of said display plates having a contrasting face and a non-contrasting face, both faces parallel to said central pivotal axis, said contrasting face being colored with a color substantially contrasting with respect to said background color and said non-contrasting face being colored with a color substantially non-contrasting with respect to said background color, biasing means fixed to said plates and to said backboard for biasing said display plates towards said viewing frontal face of said backboard and retaining said display plates in a rest position superposed on said frontal face with either said contrasting face or said non-contrasting face flat against and covering a predetermined area of said frontal face of said backboard, said biasing means allowing any selected plate to be pivoted about its pivotal axis, the latter being translated and temporarily pulled away relative to said frontal face of said backboard to selectively expose either said contrasting face or said non-contrasting face of said selected plate, the latter then being returned to its rest position covering the same said predetermined area.

2. A display device as recited in claim 1 wherein, each one of said plates has a throughbore coaxial with said pivotal axis and substantially parallel to said contrasting and non-contrasting faces, and wherein said biasing means is a strip of substantially resilient material, said strip being fixed to said backboard and extending through said throughbore for resiliently linking said plate to said backboard while allowing rotation of said plate about said pivotal axis.

3. A display device as recited in claim 2 wherein, said plates are positioned in juxtaposed relationship forming an array of said plates, said array has a set of plate columns and a set of plate rows, in each one of said rows, said plates have their throughbores aligned in colinear relationship and extending from a first plate at a first end of said row to a last plate at a second end of said row, each one of said strips associated with one of said rows and fixed to said backboard adjacent said first plate and said last plate of said one row.

4. A display device as recited in claim 2 wherein, said plates are positioned in juxtaposed relationship forming an array of said plates, said array has a set of plate columns and a set of plate rows, in each one of said columns, said plates have their throughbores aligned in colinear relationship and extending from a first plate at a first end of said column to a last plate at a second end of said column, each one of said strips associated with one of said columns and fixed to said backboard adjacent said first plate and said last plate of said one column.

5. A display device as recited in claim 2, wherein, each one of said plates is fixed to said backboard with a corresponding strip and each one of said stripe is fixed to said backboard adjacent the ends of said throughbore.

6. A display device as recited in claim 5, wherein said plates are elongated with opposite ends and are disposed in digital format subsets, each one of said subsets comprising seven of said display plates, the central pivotal axis of three of said plates being parallel, horizontal and evenly spaced apart, one of said three plates being an intermediate plate and the remaining two of said three plates being external plates, the central pivotal axis of the remaining four plates being vertical and aligned in two opposite pairs in order to form with said three horizontal plates the numeral "8" in block digital appearance.

7. A display device as recited in claim 6 wherein said backboard has a pair of apertures associated with each plate and located adjacent said respective opposite ends of said plate, said corresponding strip extending through each associated pair of apertures and across said back face of said backboard between said apertures of said pair and forming a loop.

8. A display device as recited in claim 7 wherein, said opposite ends of said plates are wedge-shaped and one aperture is associated with the adjacent ends of one vertical plate and one outer horizontal plate, and another aperture associated with the adjacent ends of two vertical plates and said intermediate horizontal plate.

9. A display device as recited in claim 1, wherein said sides of each plate defines edges having a substantially bevelled transverse, widthwise cross-section.

* * * * *